US009502158B2

(12) United States Patent
Bes et al.

(10) Patent No.: US 9,502,158 B2
(45) Date of Patent: Nov. 22, 2016

(54) CONNECTOR

(71) Applicant: YAZAKI EUROPE LTD., Hertfordshire (GB)

(72) Inventors: Goran Bes, Zagreb (HR); Hans Nunner, Regensburg (DE); Richard Orosz, Cologne (DE); Tvrtko Rebic, Samobor (HR); Vedran Mahovic, Samobor (HR)

(73) Assignee: YAZAKI EUROPE LTD., Hertfordshire (GB)

( * ) Notice: Subject to any disclaimer, the term of this patent is extended or adjusted under 35 U.S.C. 154(b) by 0 days.

(21) Appl. No.: 14/488,860

(22) Filed: Sep. 17, 2014

(65) Prior Publication Data

US 2015/0087188 A1 Mar. 26, 2015

(30) Foreign Application Priority Data

Sep. 25, 2013 (EP) ..... 13186041

(51) Int. Cl.

| | |
|---|---|
| ***H01R 13/514*** | (2006.01) |
| ***H01R 13/506*** | (2006.01) |
| ***H01B 11/12*** | (2006.01) |
| ***H01R 13/436*** | (2006.01) |
| ***H01R 13/518*** | (2006.01) |
| *H01R 13/6463* | (2011.01) |

(52) U.S. Cl.

CPC ..... *H01B 11/125* (2013.01); *H01R 13/4361* (2013.01); *H01R 13/518* (2013.01); *H01R 13/6463* (2013.01); *Y10T 29/49174* (2015.01)

(58) Field of Classification Search

CPC .... H01R 13/514; H01R 13/506; H01R 9/26; H01R 9/2608; H01R 13/518

See application file for complete search history.

(56) References Cited

U.S. PATENT DOCUMENTS

| | | | | | |
|---|---|---|---|---|---|
| 3,547,274 | A * | 12/1970 | Sosinkski | H01R 13/518 | 211/26 |
| 3,850,301 | A * | 11/1974 | Flenige | H01R 9/26 | 211/162 |
| 4,762,508 | A * | 8/1988 | Tengler | H01R 13/514 | 439/607.35 |
| 4,923,310 | A * | 5/1990 | Sekiguchi | H01R 13/516 | 439/540.1 |
| 5,108,313 | A * | 4/1992 | Adams | H01R 13/514 | 439/607.47 |
| 5,725,397 | A * | 3/1998 | Fukamachi | H01R 13/518 | 439/596 |

(Continued)

FOREIGN PATENT DOCUMENTS

| | | |
|---|---|---|
| DE | 19739503 A1 | 3/1999 |
| DE | 20 2012 007 577 U1 | 11/2012 |

(Continued)

OTHER PUBLICATIONS

Communication dated Aug. 4, 2015, issued by the Japan Patent Office in corresponding Japanese Application No. 2014-194236.

(Continued)

*Primary Examiner* — Gary Paumen
(74) *Attorney, Agent, or Firm* — Sughrue Mion, PLLC

(57) ABSTRACT

Connector 1 comprising:

- a plurality of twisted-pair cables 6 each comprising two twisted wires 7, 8, each of said wires 7, 8 being connected to a terminal 23, 24;
- a plurality of cavity blocks 9, each of said cavity blocks 9 has two cavities 17, 18 for accommodating the terminals 23, 24 of one of said twisted-pair cables 6;
- a housing 3 having an accommodation chamber 10 for accommodating the plurality of said cavity blocks 9.

13 Claims, 4 Drawing Sheets

(56) References Cited

U.S. PATENT DOCUMENTS

| | | | | |
|---|---|---|---|---|
| 5,775,954 | A * | 7/1998 | Kerckhof | H01R 13/514 439/701 |
| 6,832,937 | B1 * | 12/2004 | Wrede | H01R 13/4361 439/358 |
| 7,572,154 | B2 * | 8/2009 | Ichio | H01R 13/4361 361/735 |
| 8,668,530 | B2 * | 3/2014 | Riepe | H01R 13/518 439/532 |
| 2003/0100228 | A1 * | 5/2003 | Bungo | B23K 20/10 439/701 |
| 2004/0266273 | A1 * | 12/2004 | Wu | H01R 13/514 439/701 |
| 2007/0004272 | A1 | 1/2007 | Pratt | |
| 2007/0128951 | A1 | 6/2007 | Leddy | |
| 2008/0003890 | A1 * | 1/2008 | Minich | H01R 12/724 439/701 |

FOREIGN PATENT DOCUMENTS

| | | | |
|---|---|---|---|
| DE | 10 2011 078 736 | A1 | 1/2013 |
| JP | 4-129483 | U | 11/1992 |
| JP | 05-090841 | U | 12/1993 |
| JP | 08-330017 | A | 12/1996 |
| JP | 2005-510837 | A | 4/2005 |
| WO | 03/045616 | A1 | 6/2003 |

OTHER PUBLICATIONS

Communication dated Dec. 8, 2015, issued by the Japan Patent Office in corresponding Japanese Application No. 2014-194236.

* cited by examiner

CONNECTOR

The present invention refers to a connector with twisted-pair cables and to a method for assembling a connector with twisted-pair cables.

It is well known to twist pairs of wires in order to reduce the sensitivity of the conductors of the wires for electromagnetic interference signals. In a transition region of the wires between a twisted area of the wires and a connector, which is connected to the wires, the wires are untwisted. This untwisted region of the wires is necessary as each wire end is connected to a terminal and the terminals have to be inserted into a housing of the connector. The untwisted region of the wires provides for an easy handling of the wire ends while inserting same into the housing. The region of untwisted wires has typically a length of more than two centimeters. In this area of untwisted wires electromagnetic interference signals can be radiated into the conductors of the wire. Furthermore, in this area the impedance of the wires is increased significantly. Both lead to constraints of the maximum data transmission rate via the twisted-pair cables.

In the prior art wires are twisted with wire twisting machines, in which a gripper grips the wires behind the terminals which are connected to the wire ends. In order to facilitate an insertion of the terminals into a connector housing the ends of the wires remain untwisted, typically in a region of at least two centimeters.

The object of the invention is to provide a connector having a plurality of twisted-pair cables and having a higher data transfer rate capacity. Further, an object of the invention is to provide a method for assembling such a connector.

The object is solved by a connector according to claim 1 and a method according to claim 15. Preferred embodiments are described in the dependent sub-claims.

According to the invention the terminals of the twisted-pair cables are not directly inserted into cavities of the connector housing. The terminal of each twisted-pair cable are inserted in cavities of a cavity block which is separate from the housing of the connector. The cavity blocks of each twisted-pair cable are then inserted into an accommodation chamber of the housing of the connector. Each cavity block has two cavities for terminals and allow to insert the terminals of each pair of wires when the wires are still untwisted. After inserting the terminals of the wires the cavity block can be rotated in order to twist the pairs of wires to twisted-pair cables. Due to the fact that the terminals do not have to be inserted into cavities of the connector after the wires have been twisted it is possible to reduce the length of the untwisted region of the wires of the twisted-pair cables. Hence, the conductors of the wires are much less sensitive for electromagnetic interference signals. For a number of applications a shielding of the cable is not necessary.

The design of the housing having accommodation chambers for the cavity blocks does not exclude that the housing has further cavities for terminals of further wires, such as untwisted wires.

The connector can be part of a modular system wherein the housing is selected from a group of housings having different sized accommodation chambers for accommodating a variable number of identical cavity blocks. Identical cavity blocks can be inserted in different housings so that connectors with a variable number of poles can be provided without the necessity to provide specially designed cavity blocks. Consequently, it is possible to assemble variable scaled connectors with different numbers of poles using the same twisted-pair cables with cavity blocks.

The cavity blocks are inserted into the accommodation chamber in an insertion direction which is traverse to a mating direction for mating the connector with a counter-connector. Typically, in well known connectors according to the prior art the terminals are inserted into cavities of the connector housing in the mating direction. Inserting the cavity blocks of the connector according to the invention in the mating direction of the connector would make it necessary to lock each individual cavity block within the housing. This can be avoided by inserting the cavity blocks in an insertion direction traverse to the mating direction of the connector. The cavity blocks can be held within the accommodation chamber by designing the accommodation chamber in such a way that the cavity blocks cannot be pulled out of the accommodation chamber in the mating direction.

The cavity blocks are inserted into the accommodation chamber through a common opening of the housing.

The cavity blocks are held side by side abutting one another within the accommodation chamber. It is not necessary to provide walls between the cavity blocks. The cavity blocks as well as the accommodation chambers have a simple design.

Preferably the housing comprises a guiding means for guiding the cavity blocks while being inserted into the accommodation chamber. The guiding means can comprise at least one guiding web at an inside of a side wall of the housing. The cavity blocks then comprise a guiding recess for sliding each cavity block on the at least one guiding web. The guiding web serves as a rail for the cavity blocks.

It is possible that the guiding means comprises two guiding webs each being arranged at an inside of a sidewall of the housing wherein the two guiding webs can be arranged opposite to each other. Hence, two rows of cavity blocks within the accommodation chamber are possible.

Preferably, the guiding web defines an undercut and the guiding recess is designed with a complementary undercut for locking the cavity block onto the guiding web while being slidable in insertion direction on the guiding web. The cavity blocks, therefore, can be slit in insertion direction onto the guiding web. However, the cavity blocks are locked onto the guiding web in a direction traverse to the insertion direction.

Additionally, the guiding web and the cavity blocks as well as the terminals can be designed in such a way that the guiding web locks the terminals within the cavity blocks and serves as a secondary locking. The housing comprises holding means for holding the cavity blocks within their accommodation chamber of the housing. The holding means, preferably, comprise a projection supported against the last inserted cavity block for holding the cavity block within their accommodation chamber. The projection can be part of a resilient flexible arm which snaps back when the last cavity block is inserted completely in the accommodation chamber.

The method for assembling a connector as described above comprises the steps of:

- providing a plurality of pairs of wires;
- connecting each wire to a terminal;
- providing one cavity block per each pair of wires;
- inserting the terminals of each pair of wires into the respective cavity block and subsequently twisting the wires of each pair of wires forming twisted-pair cables; and
- inserting the cavity blocks of each twisted-pair cable into an accommodation chamber of a housing.

Preferably, for twisting the wires of each pair of wires each cavity block is rotated in a respect to the wires.

Preferred embodiments of the present invention are described in more detail referring to the drawings.

Figure 1:
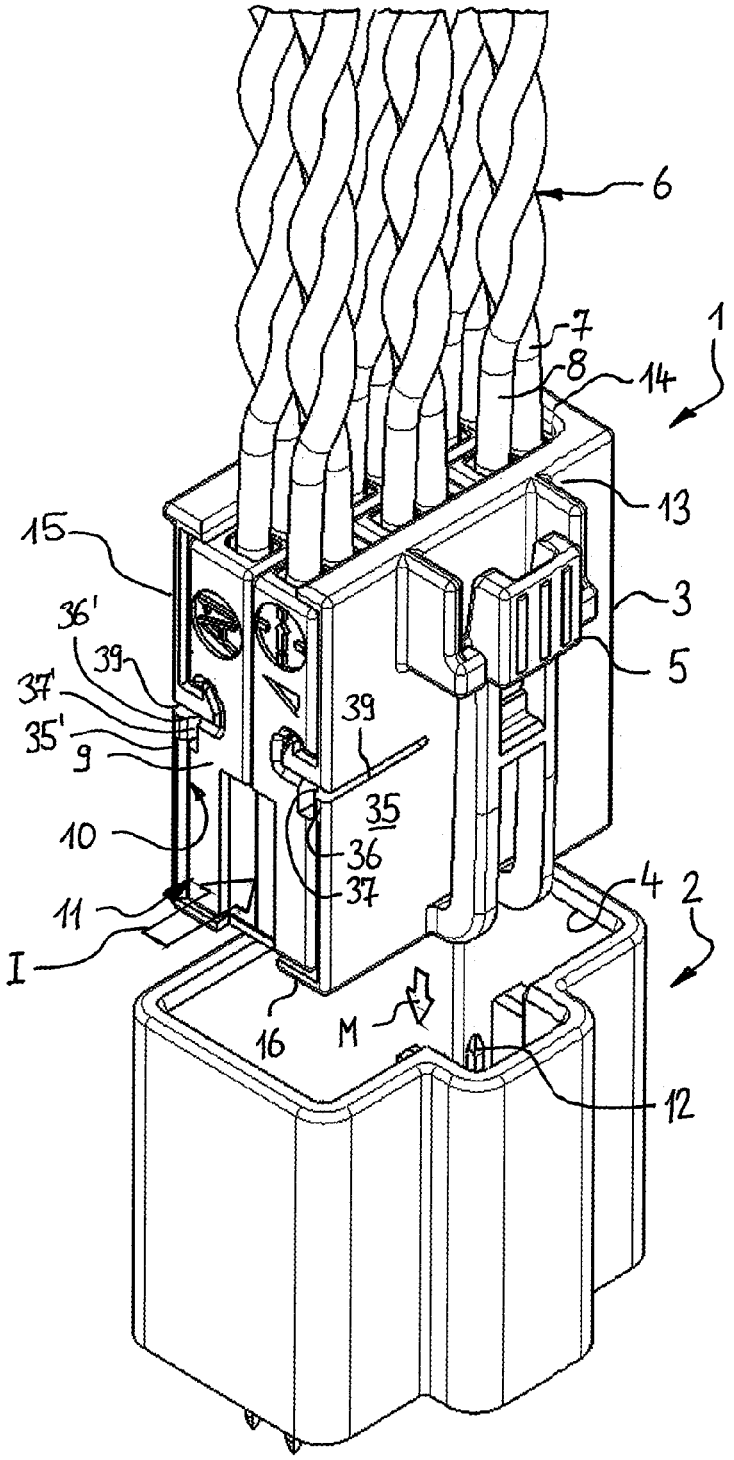
FIG. 1 is a perspective view of a connector having a plurality of cavity blocks with twisted-pair cables and a counter-connector.

FIG. 1 discloses a connector 1 to be mated with a counter-connector 2 in a mating direction M. The connector 1 has a housing 3 which, for mating the connector 1 with the counter-connector 2, can be inserted into a receptacle 4 of the counter-connector 2. The housing 3 comprises an elastic flexible locking arm 5 which engages with a locking projection (not shown) in the receptacle 4 of the counter-connector 2 in order to lock the connector 1 within the counter-connector 2 in a well known manner. Alternatively, other locking mechanisms which are well known to a person skilled in the art can be used.

The connector 1 comprises a plurality, in the disclosed embodiment six, twisted-pair cables 6. Each twisted-pair cable 6 has a pair of wires 7, 8 which are twisted. Each wire 7, 8 has a wire end which is connected to a terminal (not shown). The terminals are to be connected to counter-terminals 12 of the counter-connector 2. In the disclosed embodiment the terminals at the end of the wires 7, 8 are female terminals and the counter-terminals 12 of the counter-connector 2 are male terminals. This, of course, can be vice-versa.

Each terminal of the wires 7, 8 of each twisted-pair cable 6 are inserted into a cavity block 9 wherein for each twisted-pair cable 6 one cavity block 9 is provided. All cavity blocks 9 are inserted in an insertion direction I into an accommodation chamber 10 of the housing 3 through an opening 11. The housing 3 comprises a first side wall 13, a second side wall 14 and a third side wall 15. The side walls 13, 14, 15 are substantially parallel to the mating direction M. The first side wall 13 and the third side wall 15 are parallel to each other connected by the second side wall 14 wherein the second side wall 14 is perpendicular to the first side wall 13 and the third side wall 15. The side walls 13, 14, 15 are defining the accommodation chamber 10. Opposite to the second side wall 14 there is provided the opening 11 for inserting the cavity blocks 9 into the accommodation chamber 10.

In direction towards the counter-connector 2 the housing 3 comprises a bottom wall 16.

Figure 2:
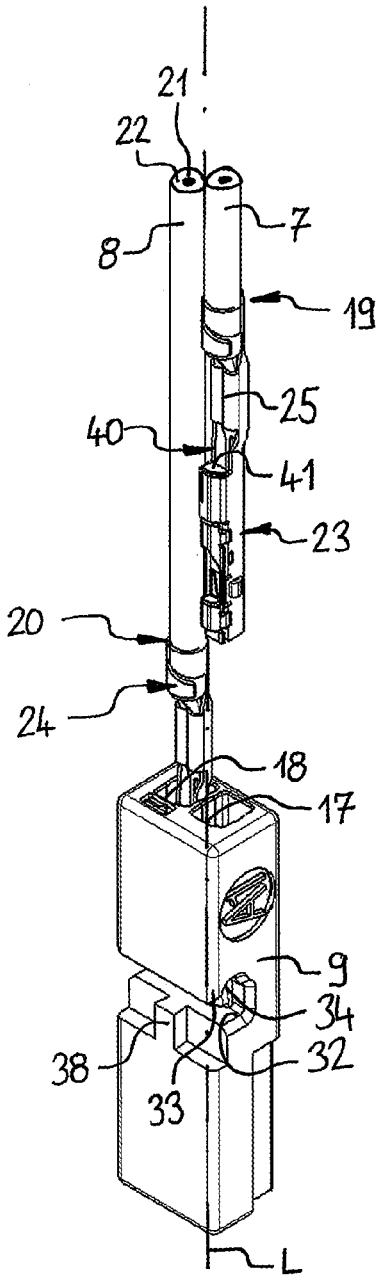
FIG. 2 is a perspective view of a cavity block according to FIG. 1 with two untwisted wires to be inserted into cavities of the cavity block.
Figure 3:
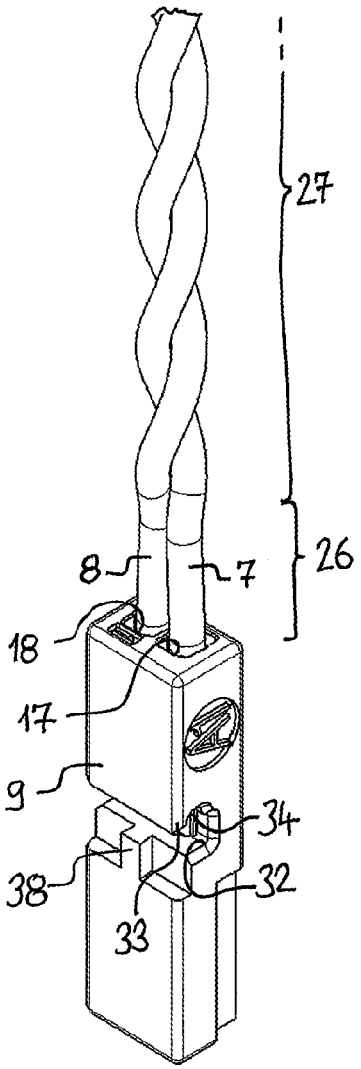
FIG. 3 is a perspective view of the cavity block according to FIG. 2 with inserted wires twisted to a twisted-pair cable.

FIGS. 2 and 3 disclose one cavity block 9 with wires 7, 8 as representative for all cavity blocks and wires according to FIG. 1. FIG. 2 illustrates the assembly of the cavity block 9 and FIG. 3 the completely assembled cavity block 9. FIGS. 2 and 3 are described together.

The wires 7, 8 each comprise a conductor 21 for transmitting an electric signal. The conductor 21 is covered by an electrical insulation 22. Each wire 7, 8 has a wire end 19, 20 which is connected to a terminal 23, 24. At the wire ends 19, 20 the insulation 22 is stripped off the conductor 21. The wire ends 19, 20 are each connected via a crimping connection 25 to the terminals 23, 24 wherein the crimping connection 25 provides an electric contact between the electrically conductive terminal 23, 24 and the conductor 21. The wires 7, 8 can be part of a network for transmitting data in a computer network, such as a network of a motor vehicle or the like.

The cavity block 9 extends substantially in the direction of a longitudinal axis L and comprises two cavities 17, 18 extending parallel to the longitudinal axis L. Each of the terminals 23, 24 is inserted into one of the cavities 17, 18 in a direction parallel to the longitudinal axis L. The terminals 23, 24 and the cavity block 9 comprise locking features for providing a primary locking within the cavities 17, 18 as well known in the prior art. The terminals 23, 24 are completely received within the cavities 17, 18 so that only the wires protrude out of the cavities 17, 18. The terminals 23, 24, however, can also be arrange such that of the terminals 23, 24 protrude partly out of the cavities 17, 18. The terminals 23, 24 are inserted into the cavities 17, 18 from a back side of the cavity block 9. On a front side, which is opposite to the back side, the cavity block 9 comprises through holes (not shown) leading into the cavity blocks 9, as well known by a person skilled in the art. When mating the connector 1 to the counter-connector 2 the male terminals 12 of the counter-connector 2 can pass through the through holes in order to come into electrical contact with the female terminals 23, 24 within the cavities 9.

When inserting the terminals 23, 24 into the cavities 17, 18 the wires 7, 8 are untwisted, i.e. the wires 7, 8 are substantially straight. After the terminals 23, 24 have been inserted into the cavities 17, 18 the wires 7, 8 are twisted jointly to form a twisted-pair cable 6. For twisting the wires 7, 8 the cavity block 9 is inserted into a gripper of a twisting machine. The cable ends opposite to the cable ends 19, 20 carrying the terminals 23, 24 are also fixed in a further gripper of the twisting machine. In this stage the wires 7, 8 are held straight and parallel to each other. Then, at least one of the grippers rotates about the longitudinal axis L so that the wires 7, 8 are jointly twisted one around the other. As a result, the wires 7, 8 are twisted to form a twisted-pair cable 6 as shown in FIG. 3. The gripper grips the cavity block 9 and a transition region of the pair of wires 7, 8. Due to the fact that the gripper grips the wires 7, 8 in the transition region 26 the wires 7, 8 remain untwisted in the transition region 26. Following the transition region is a twisted region 27 with the wires 7, 8 being twisted one around the other. Due to the fact that the terminals 23, 24 have been inserted into the cavity 17, 18 before the twisting of the wires 7, 8 it is not necessary to provide a long transition region 27 with untwisted wires 7, 8. The wires 7, 8 and the terminals 23, 24 do not have to be handled for inserting the terminals 23, 24 into the cavities 17, 18 of the cavity block 9 after twisting. Therefore, the transition region 26 can be kept as short as possible in order to avoid an increased impedance.

Figure 4:
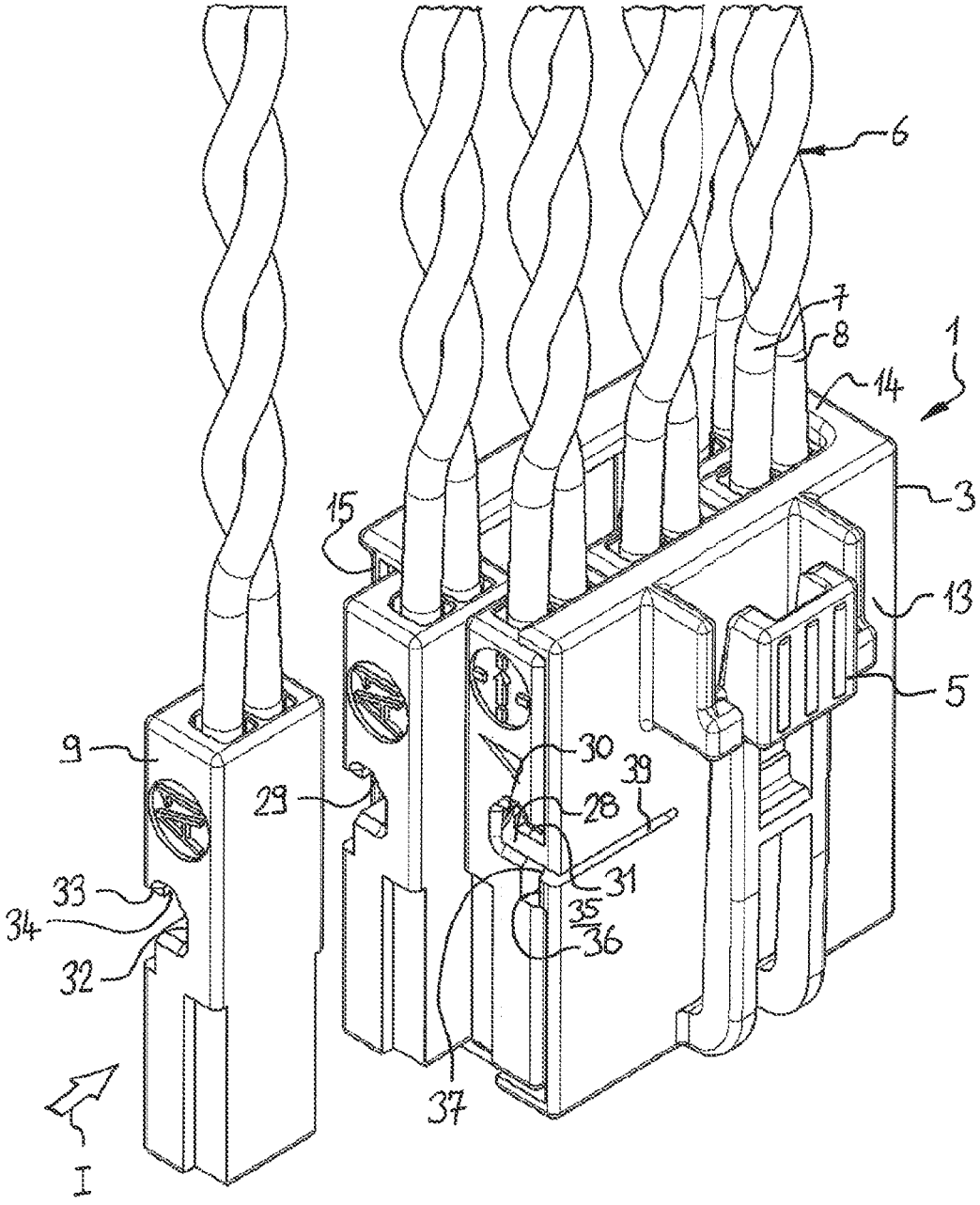
FIG. 4 is a perspective view of the connector according to FIG. 1 illustrating the insertion of the cavity blocks into the connector housing.

FIG. 4 illustrates the insertion of the cavity blocks 9 into the accommodation chamber 10 of the housing 3. The cavity blocks 9 are inserted through the opening 11 into the accommodation chamber 10 in the insertion direction I. In the embodiment according to FIG. 4 two rows of three cavity blocks 9 are provided. A first row being arranged in abutment to an inside of the first side wall 13 and a second row being in abutment to an inside of the third side wall 15. Furthermore, adjacent cavity blocks 9 are abutting each other. In FIG. 4 it can be seen that the first row of cavity blocks 9 is completely inserted and the second row of cavity blocks 9 is partially inserted. In order to avoid that in this state the cavity blocks 9 which have already been inserted into the accommodation chamber 10 move freely within the accommodation chamber 10 colliding with cavity blocks 9 to be inserted, the cavity blocks 9 and the first side wall 13 and the third side wall 15 of the housing 3 are provided with guiding means. On the inside of the first side wall 13 is a first guiding web 28 or rib which extends along the insertion direction I about the entire length of the first side wall 13. The first guiding web 28 projects from the inside of the first side wall 13 and has a hook portion 30. The hook portion 30 also extends along the entire length of the first side wall 13 and forms an undercut 31. The third side wall 15 is provided with a second guiding web 29 which is formed identical to the first guiding web 28 opposite to the first guiding web 28.

The cavity blocks 9 each have a guiding recess 32. With said guiding recess 32 the cavity blocks 9 are slid onto one of the guiding webs 28, 29 so that the cavity blocks 9 can be moved along the respective guiding web 28, 29 in the insertion direction I. The guiding recess 32 has a shoulder 33 forming an undercut 34, which is complementary to the undercut of the guiding webs 28, 29. The cavity block 9 being arranged on one of the guiding webs 28, 29 is supported with the shoulder 33 against the hook portion 30 of the respective guiding web 28, 29 so that the cavity block 9 cannot be removed from the guiding web 28, 29 in a direction traverse to the insertion direction I. On the guiding web 28, 29 the cavity blocks 9 can only be moved along the guiding webs 28, 29 in or against the insertion direction I.

The first side wall 13 and the third side wall 15 each comprising a resilient wall portion 35, 35' delimited by a slot 39, 39' in the first side wall 13 and the third side wall 15, respectively. Said resilient wall portions 35, 35' have projections 36, 36' projecting into the accommodation chamber 10 and being arranged in the area of the opening 11. The projections 36, 36' each have a chamfer surface 27, 27'. When a cavity block 9 is inserted into the opening 11 a locking nib 38 of the cavity block 9 rides on the chamber surface 37 deflecting the resilient wall portion 35 outwardly. After passing the projection 36 the resilient wall portion 35 snaps back and holds the locking nib 38 so that the cavity block 9 cannot be removed out of the accommodation chamber 10 without manually or by a tool deflecting the resilient wall portion 35.

The guiding recess 32 is open towards the cavities 17, 18 in the cavity block 9. When the cavity block 9 is slid onto one of the guiding webs 28, 29 the respective guiding web 28, 29 protrudes into the cavities 17, 18. The terminals 23, 24 are provided with a locking recess 40 which is arranged in the area of the guiding recess 32. The locking recess 40 defines a locking surface 41 facing in a direction opposite to the insertion direction of the terminals 23, 24 and being supported against the guiding web 28, 29 protruding into the cavities 17, 18. The guiding webs 28, 29, hence, act as a secondary locking mechanism to hold the terminals 23, 24 within the cavity block 9.

Figure 5:
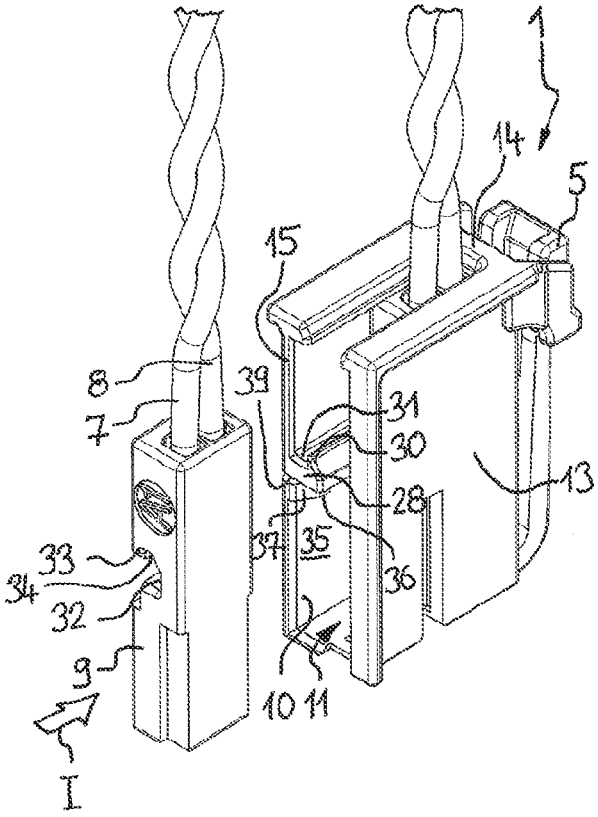
FIG. 5 is a perspective view of a second embodiment of a connector illustrating the insertion of a cavity block into the housing of the connector.
Figure 6:
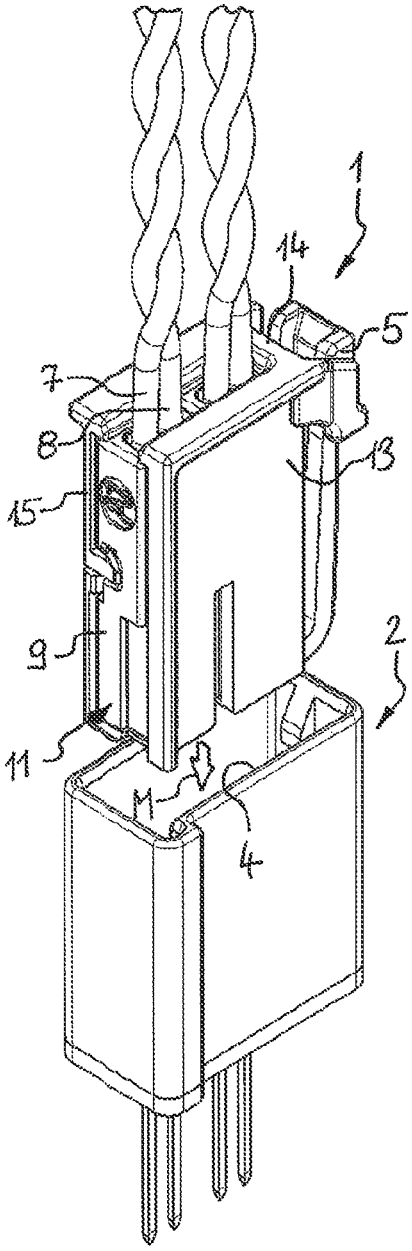
FIG. 6 is a perspective view of the connector according to FIG. 5 with inserted cavity blocks and a second embodiment of a counter-connector.

FIGS. 5 and 6 illustrate a second embodiment of a connector. Elements which are functionally identical to elements of the first embodiment are provided with the same reference numerals and described in connection with the first embodiment.

In contrast to the first embodiment the second embodiment is a four pole connector having two cavity blocks 9, which are identical to the cavity blocks 9 as used in the first embodiment. The two cavity blocks 9 are inserted in one row along the insertion direction I. Therefore, it is only necessary to provide one guiding web 29 at the third side wall 15 of the housing 3.

For locking the cavity blocks 9 within the housing 3, the housing has a slot 39 adjacent and parallel to the guiding web 29. The complete third side wall 15 is elastical and is provided with a projection 36 adjacent to the slot 39 having a chamfer surface 37. Hence, the part of the third side wall 15 having the projection 36 is deflected when a cavity block 9 is inserted into the accommodation chamber 10.

REFERENCE NUMERALS LIST

1 connector
2 counter-connector
3 housing
4 receptacle
5 locking arm
6 twisted-pair cable
7 wire
8 wire
9 cavity block
10 accommodation chamber
11 opening
12 counter-terminal
13 first side wall
14 second side wall
15 third side wall
16 bottom wall
17 cavity
18 cavity
19 wire end
20 wire end
21 conductor
22 insulation
23 terminal
24 terminal
25 crimp connection
26 transition region
27 twisted region
28 first guiding web
29 second guiding web
30 hook portion
31 undercut
32 guiding recess
33 shoulder
34 undercut
35, 35' resilient wall portion
36, 36' projection
37, 37' chamfer surface
38 locking nib
39, 39' slot
40 locking recess
41 locking surface
I insertion direction
L longitudinal axis
M mating direction

The invention claimed is:

1. A connector comprising:

a plurality of twisted-pair cables each comprising two twisted wires, each of said wires being connected to a terminal;

a plurality of cavity blocks, each of said cavity blocks has two cavities for accommodating said terminals of one of said twisted-pair cables;

a housing having an accommodation chamber for accommodating the plurality of said cavity blocks; and at least one guiding web at an inside of a side wall of the housing for guiding the cavity blocks while being inserted into the accommodation chamber, wherein the guiding web locks the terminals within the cavity blocks.

2. The connector according to claim 1, wherein the housing is selected from a group of housings having different sized accommodation chambers for accommodating a variable number of identical cavity blocks.

3. The connector according to claim 1, wherein the cavity blocks are inserted into the accommodation chamber in an insertion direction traverse to a mating direction for mating the connector with a counter-connector.

4. The connector according to claim 1, wherein the cavity blocks are inserted into the accommodation chamber through an opening of the housing.

5. The connector according to claim 1, wherein the cavity blocks are held side by side abutting one another within the accommodation chamber.

6. The connector according to claim 1, wherein the guiding means comprises two guiding webs each being arranged at an inside of a side wall of the housing.

7. The connector according to claim 6, wherein the two guiding webs are arranged opposite to each other.

8. The connector according to claim 1, wherein the cavity blocks comprise a guiding recess for sliding the cavity blocks on the at least one guiding web.

9. The connector according to claim 8, wherein each guiding web defines an undercut and that the guiding recess is designed with a complementary undercut for locking the cavity block onto the guiding web while being slidable in insertion direction.

10. The connector according to claim 1, wherein the housing comprises holding means for holding the cavity blocks within the accommodation chamber of the housing.

11. The connector according to claim 10, wherein the holding means comprise a projection supported against the last inserted cavity block for holding the cavity block within the accommodation chamber.

12. A method for assembling a connector according to claim 1, with the steps of:

providing a plurality of pairs of untwisted wires;

connecting each untwisted wire to a terminal;

providing one cavity block per each pair of untwisted wires;

inserting the terminals of each pair of untwisted wires into the respective cavity block and subsequently twisting the wires of each pair of wires forming twisted-pair cables; and inserting the cavity blocks of each twisted-pair cable into an accommodation chamber of a housing.

13. Method according to claim 12, wherein for twisting the wires of each pair of wires each cavity block is rotated in respect to the wires.

* * * * *